US012630967B2

(12) United States Patent
Acker et al.

(10) Patent No.: US 12,630,967 B2
(45) Date of Patent: May 19, 2026

(54) FOREIGN PARTICULATE REMOVAL ASSEMBLY OF A LAUNDRY APPLIANCE

(71) Applicant: WHIRLPOOL CORPORATION, Benton Harbor, MI (US)

(72) Inventors: Rachael Kelley Acker, Benton Harbor, MI (US); Pawan Arora, Chicago, IL (US); Ryan Robert Bellinger, St. Joseph, MI (US); Timothy Noah Blatchley, Stevensville, MI (US); Mark Jason Christensen, Stevensville, MI (US); Alex Perry Hoffmann, Benton Harbor, MI (US); Ryan Douglas Kuhn, St. Joseph, MI (US); Derek James Morgan, St. Joseph, MI (US); Wesley Paul Traylor, St. Joseph, MI (US); Mimansa Verma, Columbus, IN (US); Gianluca Bocchino, Fiumicino (IT); Justin Q. Nguyen, Wyoming, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 951 days.

(21) Appl. No.: 17/819,452

(22) Filed: Aug. 12, 2022

(65) Prior Publication Data

US 2023/0054143 A1 Feb. 23, 2023

Related U.S. Application Data

(60) Provisional application No. 63/234,827, filed on Aug. 19, 2021.

(51) Int. Cl.
*D06F 58/02* (2006.01)
*D06F 58/04* (2006.01)
(Continued)

(52) U.S. Cl.
CPC ..... *D06F 58/22* (2013.01); *D06F 58/04* (2013.01)

(58) Field of Classification Search
CPC ..... D06F 58/22; D06F 58/02; D06F 58/04; F26B 25/007; F26B 25/005
(Continued)

(56) References Cited

U.S. PATENT DOCUMENTS 7,921,578 B2 4/2011 McAllister et al.
8,844,160 B2 9/2014 Beihoff et al.
(Continued)

FOREIGN PATENT DOCUMENTS

DE 102006030759 A1 * 1/2008 ..... A61L 9/22
EP 2559805 B1 6/2019
(Continued)

OTHER PUBLICATIONS

English copy of DE102006030759 by PE2E May 9, 2025.*
English copy of JP6656838 by PE2E May 9, 2025.*

*Primary Examiner* — Deming Wan
(74) *Attorney, Agent, or Firm* — Price Heneveld LLP

(57) ABSTRACT

A laundry appliance includes a cabinet, a drum, a housing, a foreign particulate removal assembly, and a blower. The foreign particulate removal assembly includes a first lint filter that defines a plurality of first lint filter openings, a second lint filter that defines a plurality of second lint filter openings that are smaller than the plurality of first lint filter openings, such that the second lint filter is configured to collect foreign particulates that pass through at least one of the plurality of first lint filter openings, and a binding member that couples the first lint filter to the second lint filter. The foreign particulate removal assembly is operable between a collection position and a maintenance position. In the collection position, at least the second lint filter is
(Continued)

positioned within the housing. In the maintenance position, the second lint filter is positioned outside of the housing.

20 Claims, 15 Drawing Sheets

(51) Int. Cl.
*D06F 58/22* (2006.01)
*F26B 25/00* (2006.01)

(58) Field of Classification Search
USPC ..... 34/82, 603, 242, 246, 250
See application file for complete search history.

(56) References Cited

U.S. PATENT DOCUMENTS

| | | | | |
|---|---|---|---|---|
| 2011/0030234 | A1 | 2/2011 | Park et al. | |
| 2013/0205840 | A1* | 8/2013 | Hong | D06F 25/00 68/20 |
| 2014/0059881 | A1 | 3/2014 | Kim et al. | |
| 2016/0053428 | A1* | 2/2016 | Ros | D06F 58/22 34/82 |
| 2020/0071873 | A1 | 3/2020 | Kang et al. | |
| 2020/0129908 | A1 | 4/2020 | Choi et al. | |
| 2020/0340170 | A1 | 10/2020 | MacDonald, III et al. | |
| 2021/0047776 | A1 | 2/2021 | Persson et al. | |

FOREIGN PATENT DOCUMENTS

| | | | | |
|---|---|---|---|---|
| GB | 2318408 | B | 8/2000 | |
| JP | 07694 | A | 1/1995 | |
| JP | 6656838 | B2 * | 3/2020 | D06F 33/30 |
| KR | 20030032170 | A | 4/2003 | |

* cited by examiner

FOREIGN PARTICULATE REMOVAL ASSEMBLY OF A LAUNDRY APPLIANCE

CROSS-REFERENCE TO RELATED APPLICATIONS

The present application claims priority to U.S. Provisional Patent Application No. 63/234,827, filed Aug. 19, 2021, entitled FOREIGN PARTICULATE COLLECTOR FOR A LAUNDRY APPLIANCE, the entire disclosure of which is hereby incorporated herein by reference.

BACKGROUND OF THE DISCLOSURE

The present disclosure generally relates to a laundry appliance and, more specifically, to a foreign particulate removal assembly of a laundry appliance.

SUMMARY OF THE DISCLOSURE

According to one aspect of the present disclosure, a laundry appliance includes a cabinet that defines an opening, a drum operably coupled to the cabinet and accessible via the opening, a housing coupled to the cabinet, a foreign particulate removal assembly, and a blower that delivers process air along an airflow path. The foreign particulate removal assembly includes a first lint filter that defines a plurality of first lint filter openings, a second lint filter that defines a plurality of second lint filter openings that are smaller than the plurality of first lint filter openings, such that the second lint filter is configured to collect foreign particulates that pass through at least one of the plurality of first lint filter openings, and a binding member that couples the first lint filter to the second lint filter. The foreign particulate removal assembly is operable between a collection position and a maintenance position. In the collection position, at least the second lint filter is positioned within the housing. In the maintenance position, the second lint filter is positioned outside of the housing. The binding member couples the first and second lint filters, such that the first and second lint filters move in unison as the foreign particulate removal assembly moves between the collection and maintenance positions. The blower includes the first and second lint filters in the collection position of the foreign particulate removal assembly. The first lint filter is positioned upstream of the second lint filter within the airflow path.

According to another aspect of the present disclosure, a laundry appliance includes a cabinet that defines an opening, a drum operably coupled to the cabinet and accessible via the opening, a blower within the cabinet that delivers process air along an airflow path, a foreign particulate removal assembly having at least one lint filter and being operable between a collection position and a maintenance position, and a transparent panel. In the collection position of the foreign particulate removal assembly, the at least one lint filter is within the airflow path. In the maintenance position of the foreign particulate removal assembly, the at least one lint filter is outside the airflow path. The transparent panel is coupled to the cabinet proximate to the foreign particulate removal assembly in the collection position of the foreign particulate removal assembly, such that the at least one lint filter is visible through the transparent panel in the collection position of the foreign particulate removal assembly.

According to yet another aspect of the present disclosure, a laundry appliance includes a cabinet that defines an opening, a drum operably coupled to the cabinet and accessible via the opening, a door pivotably coupled to the cabinet and operable to pivot between a closed position and an open position, a housing coupled to the door, such that the housing moves with the door as the door pivots between the open and closed positions, a foreign particulate removal assembly having at least one lint filter and being operable between a collection position and a maintenance position, and a blower that delivers process air along an airflow path that includes the at least one lint filter in the collection position of the foreign particulate removal assembly and in the closed position of the door. In the closed position of the door, the door covers the opening defined by the cabinet. In the open position of the door, access to the drum is provided via the opening. In the collection position of the foreign particulate removal assembly, the at least one lint filter is positioned within the housing. In the maintenance position of the foreign particulate removal assembly, the at least one lint filter is positioned outside of the housing.

These and other features, advantages, and objects of the present disclosure will be further understood and appreciated by those skilled in the art by reference to the following specification, claims, and appended drawings.

Figure 1:
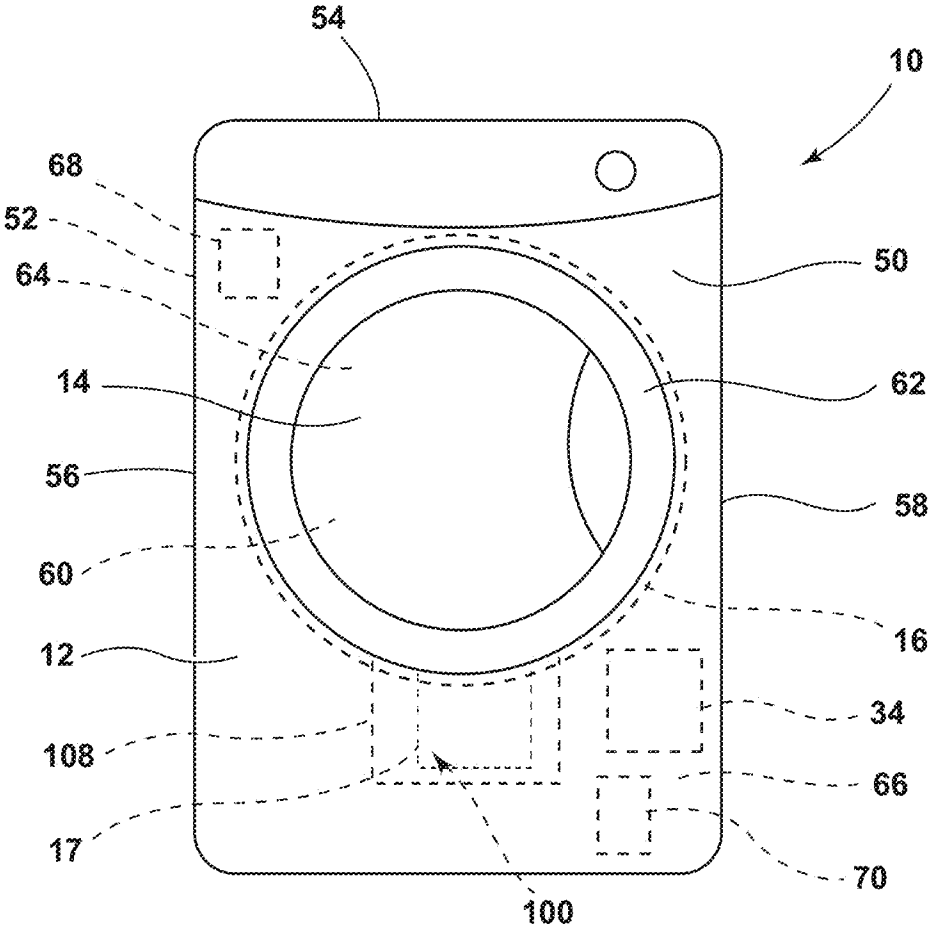
FIG. 1 is a front elevational view of a laundry appliance of the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a foreign particulate removal assembly for a laundry appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

With respect to FIGS. 1-14, reference numeral 10 generally designates a laundry appliance. The laundry appliance 10 includes a cabinet 12 that defines an opening 14. A drum 16 is operably coupled to the cabinet 12 and accessible via the opening 14. A door 62 is pivotably coupled to the cabinet 12 and is operable to pivot between a closed position, wherein the door 62 covers the opening 14 defined by the cabinet 12, and an open position, wherein access to the drum 16 is provided via the opening 14. A blower 34 positioned within the cabinet 12 delivers process air 72 along an airflow path 36. A foreign particulate removal assembly 100 having at least one lint filter 17 is operable between a collection position 104, wherein the at least one lint filter 17 is within the airflow path 36, and a maintenance position 104, wherein the at least one lint filter 17 is outside of the airflow path 36.

Figure 2:
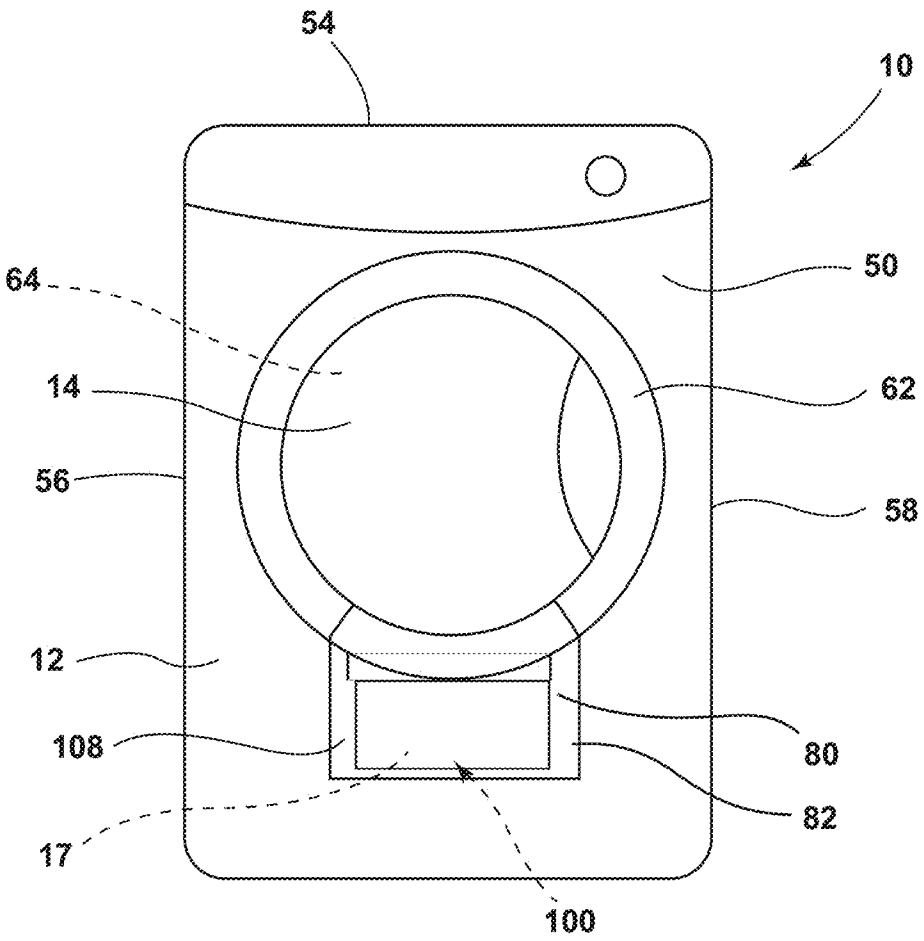
FIG. 2 is a front elevational view of a laundry appliance having a transparent portion.

Referring to FIGS. 1-2, the laundry appliance 10 can include various mechanisms for washing, drying, or otherwise processing laundry. For example, the laundry appliance 10 illustrated in FIGS. 1-14 is a laundry dryer. The laundry appliance 10 includes the cabinet 12 that includes a front side 50 and a rear side 52 that is opposite the front side 50. A top side 54 extends between the front side 50 and the rear side 52, and left and right sides 56, 58 extend downward from the top side 54 between the front side 50 and the rear side 52. The front side 50 of the cabinet 12 may define the opening 14 through which clothing items 60 may be disposed in the drum 16. The door 62 is coupled to the cabinet 12 proximate to the opening 14 and is configured to provide selective access to the drum 16 via the opening 14. Stated differently, the door 62 is operable between the open position and the closed position, such that a user may dispense clothing items 60 within a laundry cavity 64 defined by the drum 16 when the door 62 is in the open position.

It is generally contemplated that the cabinet 12 of the laundry appliance 10 can house a variety of components. For example, the drum 16 of the laundry appliance 10 is housed within the cabinet 12. The laundry appliance 10 may also define a machine compartment 66 within the cabinet 12. The machine compartment 66 may include, but is not limited to, a motor 68, a fluid pump 70, and/or the blower 34.

Figure 14:
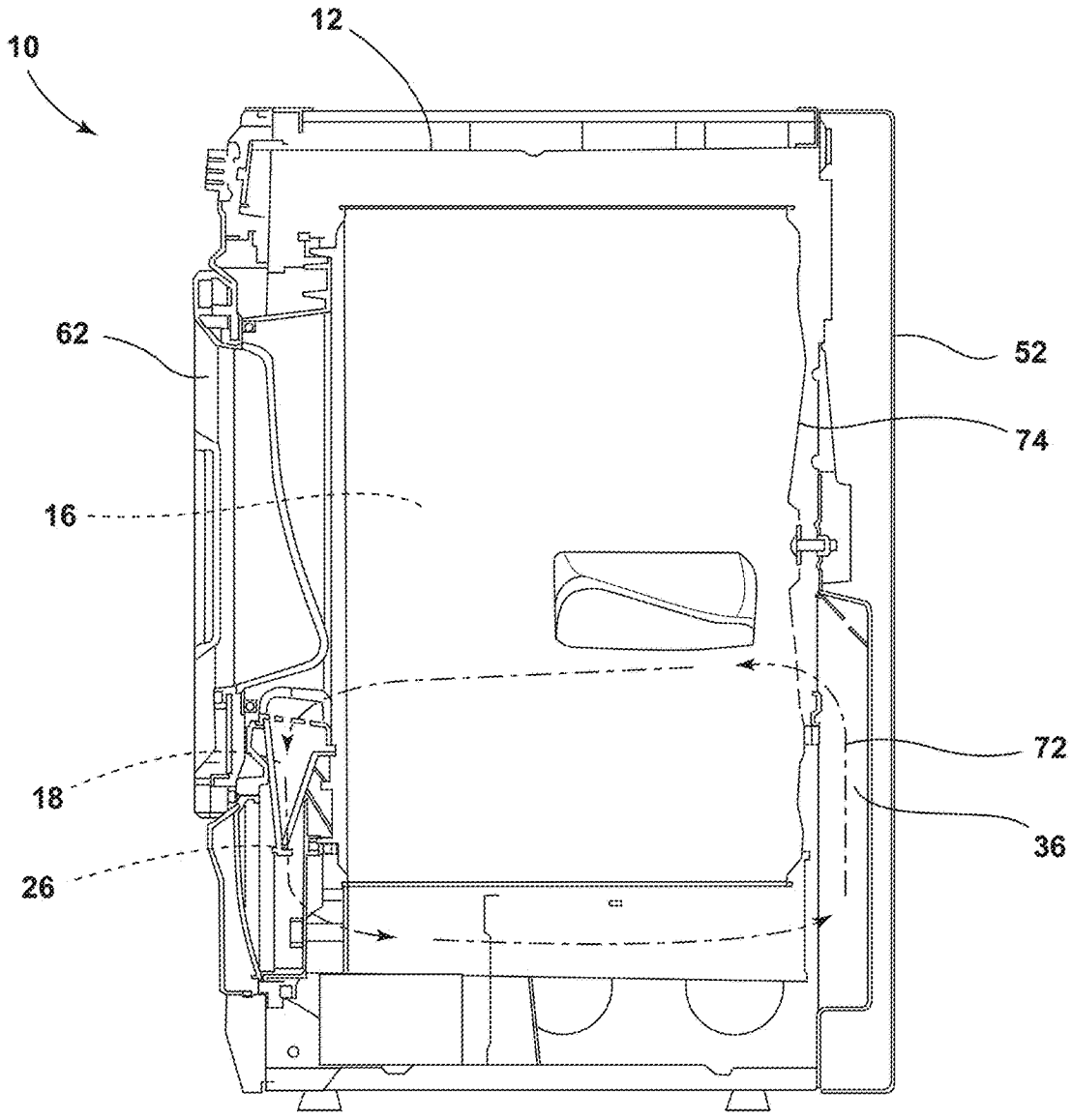
FIG. 14 is a side cross-sectional view of a laundry appliance of the present disclosure.

With further reference to FIGS. 1 and 14, the blower 34 is disposed within the laundry appliance 10 and delivers process air 72 via the airflow path 36. The blower 34 may be at least partially disposed within the machine compartment 66 of the laundry appliance 10. It is also contemplated that the blower 34 may be proximate the rear side 52 of the cabinet 12 to directly translate the airflow path 36 into the laundry cavity 64. The blower 34 can be a fan, an air handling unit, or other air-moving device that can move the process air 72 within the drum 16. The blower 34 can use positive pressure and/or negative pressure via an induced flow of the process air 72 through the drum 16. The airflow path 36 can include various air-conditioning mechanisms 78 including, but not limited to, one or more heat exchangers, electrical heaters, and other similar mechanisms that serve to heat and/or cool the process air 72 within the laundry appliance 10.

Figure 9:
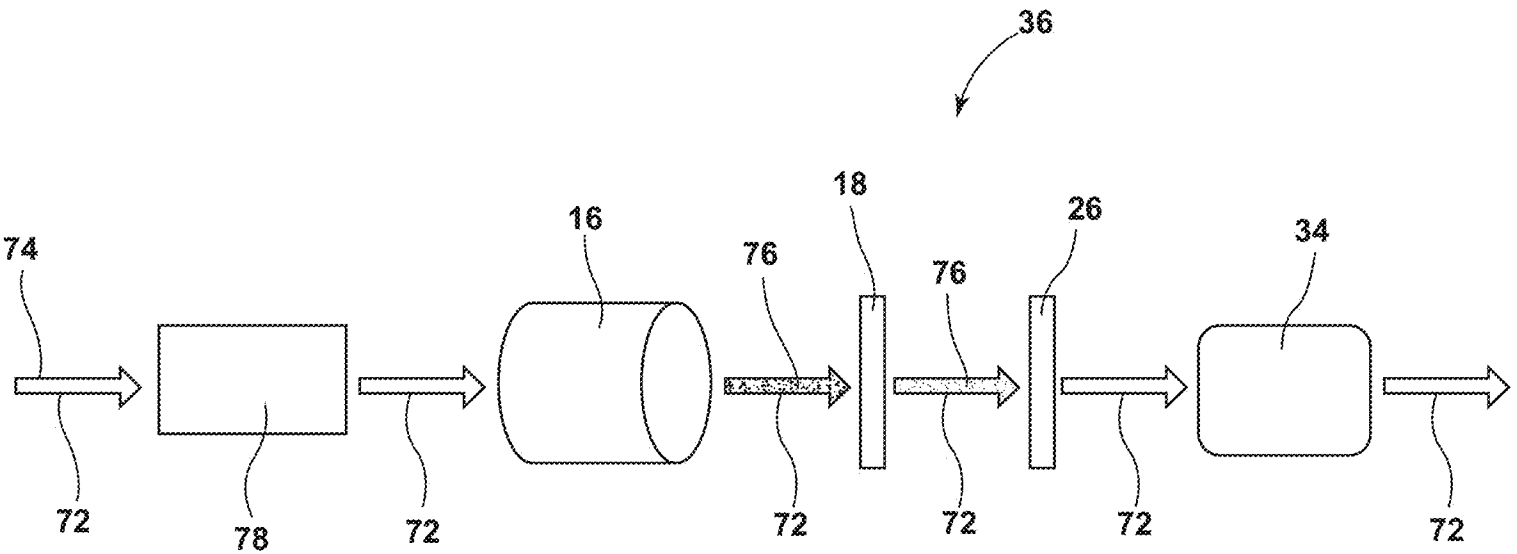
FIG. 9 is a schematic diagram of an airflow path for a laundry appliance including a first lint filter and a second lint filter.

As illustrated in FIG. 9, the process air 72 is drawn past the heat exchange mechanism 78 that heats the process air 72 as it enters the airflow path 36. The process air 72 enters the drum 16 after the process air 72 is conditioned via a ventilation plate 74 coupled to the rear side 52 of the cabinet 12. It is contemplated that a combination of foreign particulates 76 may be released from the clothing items 60 within the drum 16 during a laundry cycle, and the process air 72 directs foreign particulates 76 into the at least one lint filter 17.

Figure 5B:
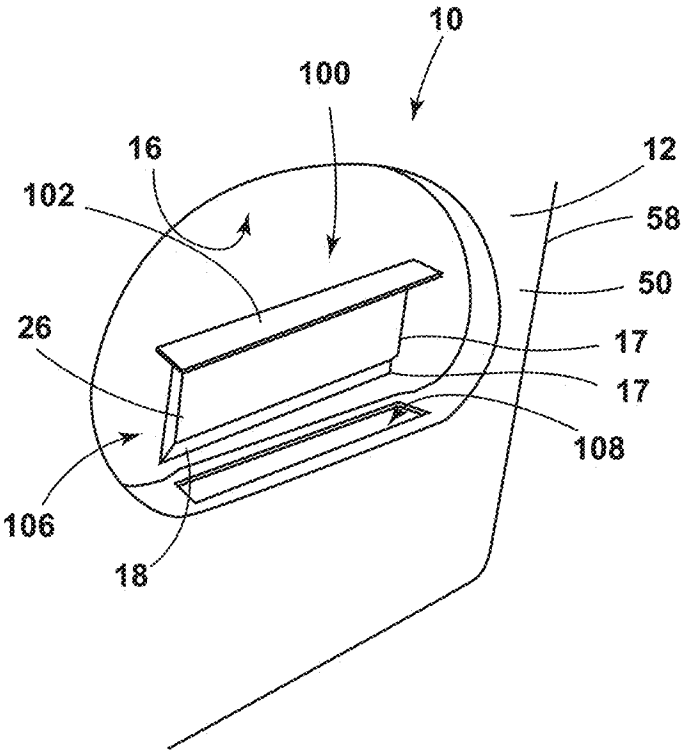
FIG. 5B is a top perspective view of a portion of a laundry appliance illustrating the foreign particulate removal assembly of FIG. 5A in a maintenance position.
Figure 5A:
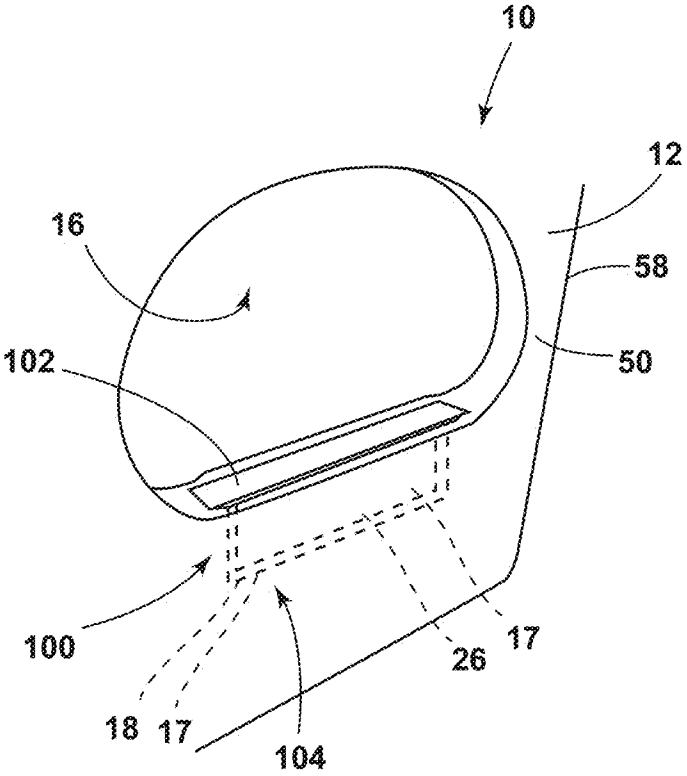
FIG. 5A is a top perspective view of a portion of a laundry appliance illustrating a foreign particulate removal assembly in a collection position such that first and second lint filters extend downward into a housing.
Figure 6:
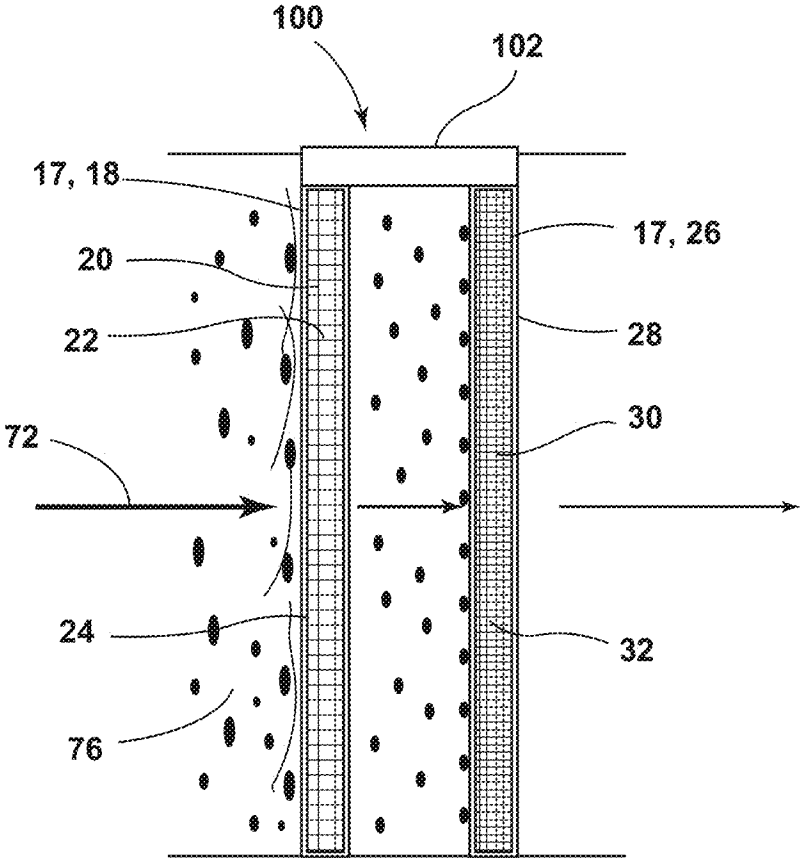
FIG. 6 is a schematic side cross-sectional view of a foreign particulate removal assembly of a laundry appliance.

Referring now to FIGS. 5A-6, the laundry appliance 10 can include the foreign particulate removal assembly 100. The foreign particulate removal assembly 100 includes the at least one lint filter 17. In some embodiments, the at least one lint filter 17 includes a first lint filter 18 and a second lint filter 26. Thus, the foreign particulate removal assembly 100 can include first and second lint filters 18, 26. The foreign particulate removal assembly 100 can include a binding member 102 that is coupled to the first and second lint filters 18, 26. In various embodiments, the binding member 102 couples the first and second lint filters 18, 26 with each other.

Figure 3:
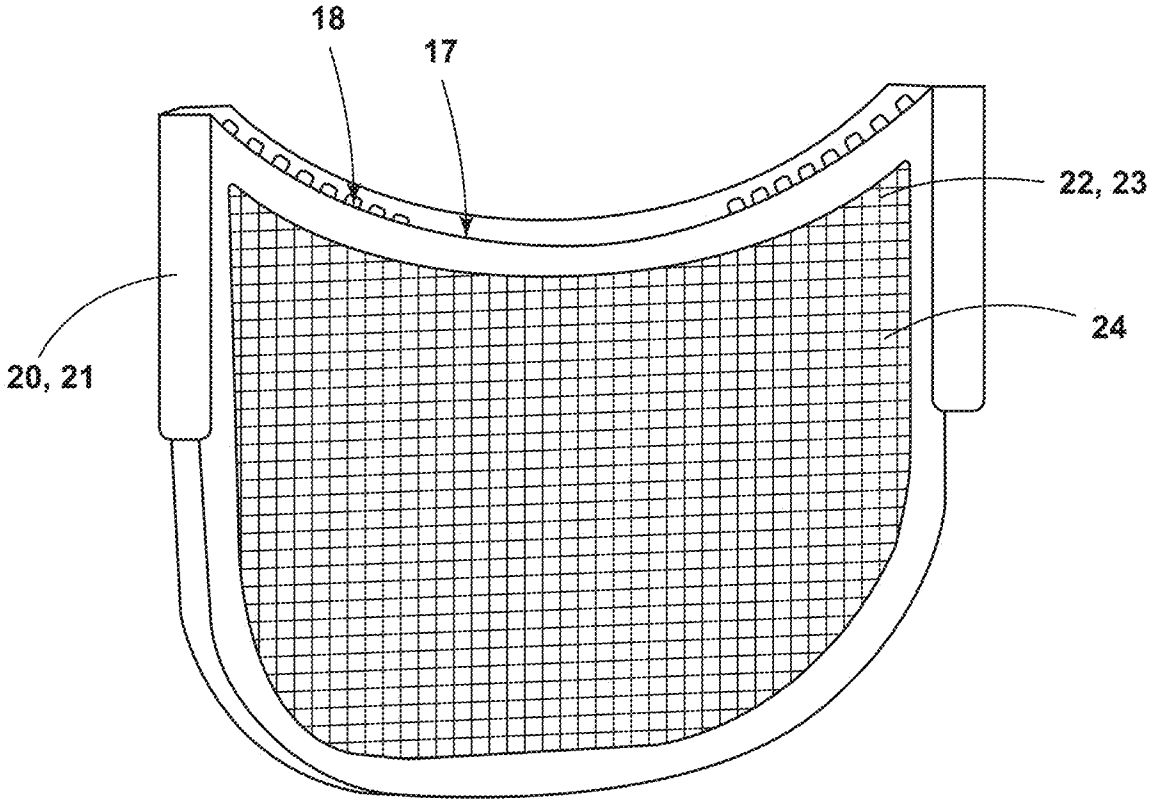
FIG. 3 is a front perspective view of a first lint filter with a first lint filter frame and a first lint filter screen for a laundry appliance.
Figure 4:
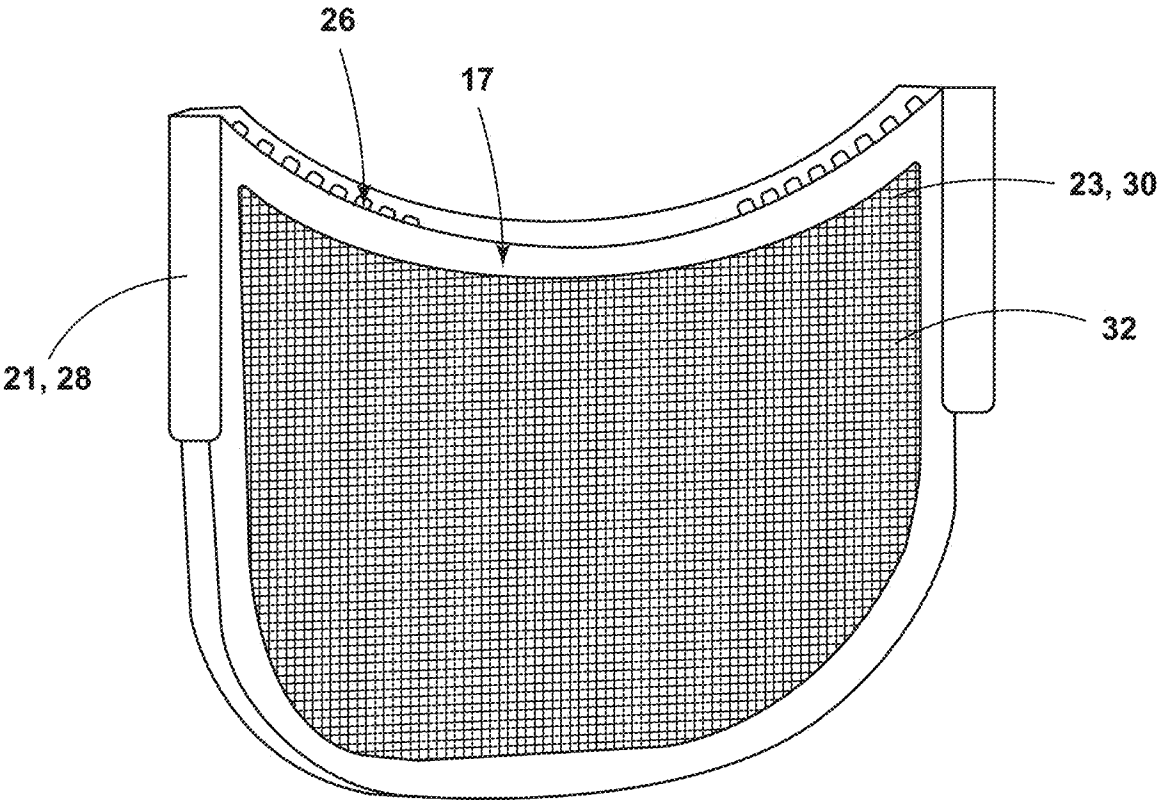
FIG. 4 is a front perspective view of a second lint filter with a second lint filter frame and a second lint filter screen for a laundry appliance.

Referring now to FIGS. 3 and 4, in some embodiments, the at least one lint filter 17 of the foreign particulate removal assembly 100 can include a frame 21 and a lint filter screen 23 coupled to the frame 21. The lint filter screen 23 extends across the frame 21 as illustrated in FIGS. 3 and 4. In some embodiments, wherein the foreign particulate removal assembly 100 includes the first and second lint filters 18, 26, the first lint filter 18 can include a first lint filter frame 20 and a first lint filter screen 22, as illustrated in FIG. 3, and the second lint filter 26 can include a second lint filter frame 28 and a second lint filter screen 30, as illustrated in FIG. 4. It is contemplated that the first and second lint filters 18, 26 may share the frame 21 in some implementations. As illustrated in FIGS. 3 and 4 and described further herein, the first lint filter screen 22 defines a plurality of first lint filter openings 24, and the second lint filter screen 30 defines a plurality of second lint filter openings 32. The first lint filter openings 24 are larger than the second lint filter openings 32, such that the second lint filter 26 is configured to filter out finer material, while the first lint filter 18 is configured to filter out larger material such as dog hair. A variety of types of filters and filtering materials are contemplated.

Referring now to FIGS. 5A, 5B, 7A, and 7B, the foreign particulate removal assembly 100 is operable between a collection position 104 and a maintenance position 106. The at least one lint filter 17 is positioned within the airflow path 36 in the collection position 104 of the foreign particulate removal assembly 100. The at least one lint filter 17 is positioned outside of the airflow path 36 in the maintenance position 106 of the foreign particulate removal assembly 100. In various embodiments, the binding member 102 couples the first and second lint filters 18, 26, such that the first and second lint filters 18, 26 move in unison as the foreign particulate removal assembly 100 moves between the collection and maintenance positions 104, 106.

Figure 8:
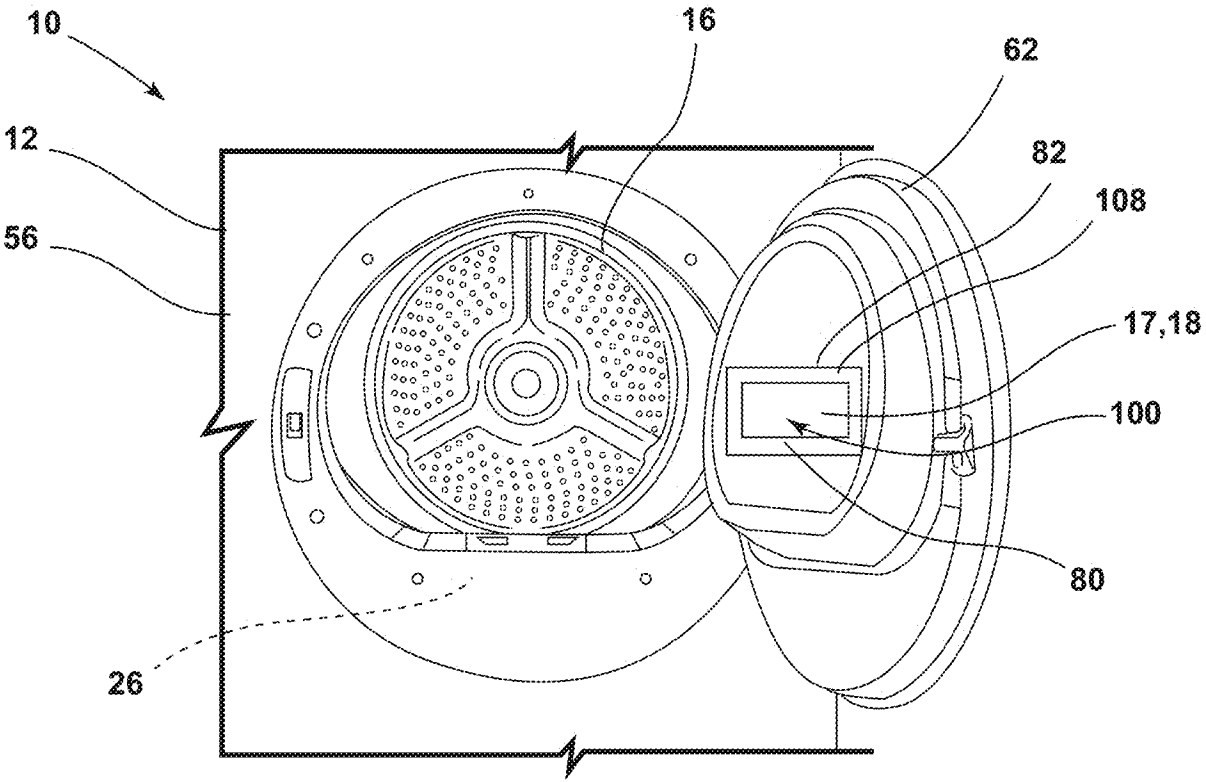
FIG. 8 is a front elevational view of a portion of a laundry appliance illustrating a foreign particulate removal assembly coupled to a door of the laundry appliance.

In various embodiments, the laundry appliance 10 can include the housing 108. The housing 108 is configured to receive the at least one lint filter 17 of the foreign particulate removal assembly 100 therein in the collection position 104 of the foreign particulate removal assembly 100. As illustrated in FIGS. 5A-5B, the housing 108 can be coupled to the cabinet 12 proximate the front side 50 of the cabinet 12 below the opening 14. In some embodiments, the housing 108 can be disposed on the door 62 of the laundry appliance 10. For example, as illustrated in FIG. 8, the housing 108 is coupled to the door 62 of the laundry appliance 10. In the illustrated embodiment, process air 72 is configured to translate through the housing 108 in the closed position of the door 62. The housing 108 is operable to move with the door 62 as the door 62 pivots between the open and closed positions. The housing 108 moving with the door 62 can allow for convenient removal of the at least one lint filter 17 from the housing 108 in the open position of the door 62. Additionally, housing 108 being generally spaced apart from the drum 16 in the open position of the door 62 can help prevent loosened foreign particulates 76 from traveling back into the drum 16 during removal of the at least one lint filter 17 from the door 62.

Referring now to FIGS. 5A and 5B, an exemplary embodiment of the laundry appliance 10 is illustrated. The laundry appliance 10 includes the housing 108 that is positioned below the opening 14 defined by the front side 50 of the cabinet 12. The laundry appliance 10 further includes the foreign particulate removal assembly 100. As illustrated in FIGS. 5A and 5B, the foreign particulate removal assembly 100 includes the first lint filter 18 and the second lint filter 26. The foreign particulate removal assembly 100 further includes the binding member 102. The binding member 102 is positioned above the first and second lint filters 18, 26 and couples the first and second lint filters 18, 26. In the collection position 104 of the foreign particulate removal assembly 100 illustrated in FIG. 5A, the first and second lint filters 18, 26 are positioned within the housing 108 below the opening 14. As illustrated, the first and second lint filters 18, 26 extend downward from the binding member 102 into the housing 108 in the collection position 104 of the housing 108.

In operation of the embodiment illustrated in FIGS. 5A and 5B, the process air 72 flows into the housing 108, through the first lint filter 18, and subsequently through the second lint filter 26. The first and second lint filters 18, 26 separate foreign particulates 76 from the process air 72 that passes through the first and second lint filters 18, 26. In various embodiments, wherein the first lint filter 18 is upstream of the second lint filter 26 in the airflow path 36, the first lint filter 18 defines the plurality of first lint filter openings 24, and the second lint filter 26 defines the plurality of second lint filter openings 32. The second lint filter openings 32 can be smaller than the first lint filter openings 24, as illustrated in FIG. 6, such that the second lint filter 26 is configured to collect foreign particulates 76 that pass through at least one of the plurality of first lint filter openings 24.

Figure 7A:
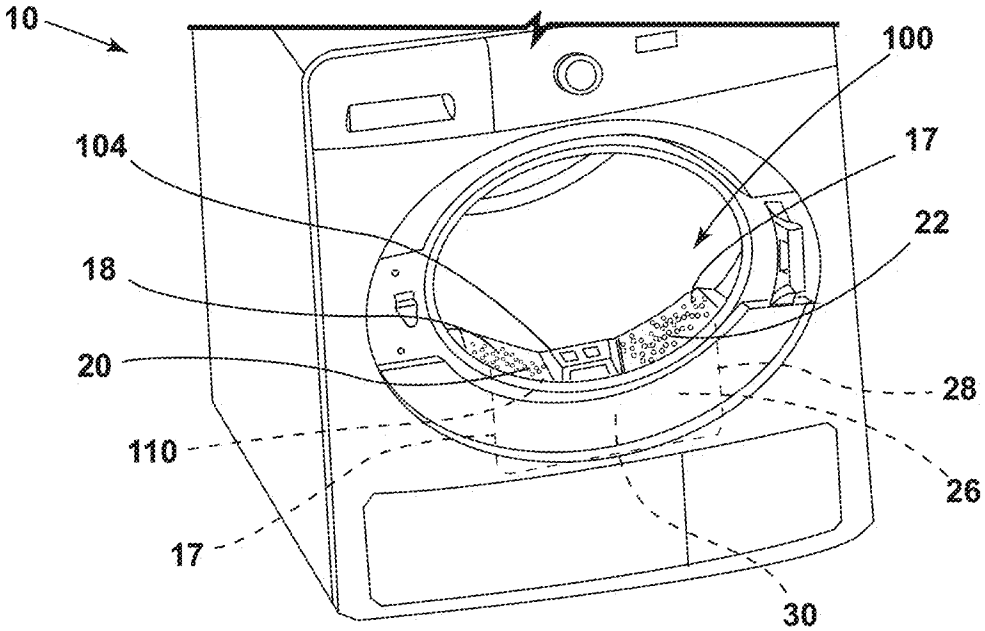
FIG. 7A is a top perspective view of a portion of a laundry appliance illustrating a foreign particulate removal assembly in a collection position.
Figure 7B:
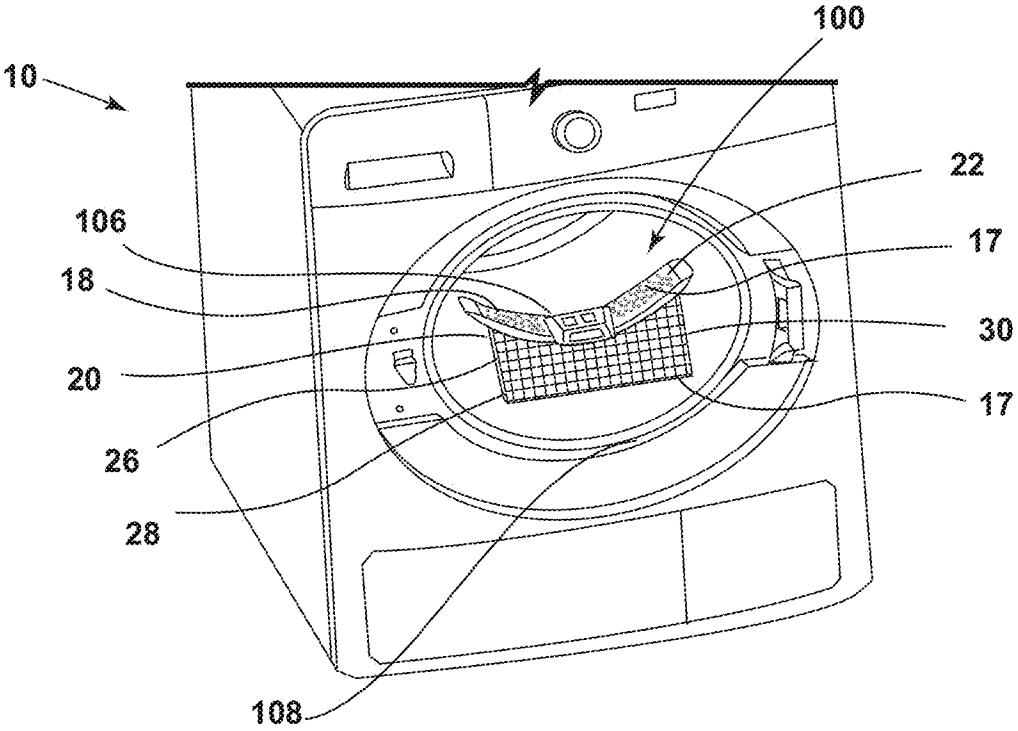
FIG. 7B is a top perspective view of a portion of a laundry appliance illustrating the foreign particulate removal assembly in a maintenance position.

Referring now to FIGS. 7A and 7B, an exemplary embodiment of the laundry appliance 10 is illustrated. The laundry appliance 10 includes the housing 108 that is positioned below opening 14 defined by the front side 50 of the cabinet 12. The laundry appliance 10 further includes the foreign particulate removal assembly 100. As illustrated in FIGS. 5A and 5B, the foreign particulate removal assembly 100 includes the first lint filter 18 and the second lint filter 26. The binding member 102 couples the first lint filter 18 with the second lint filter 26 and is positioned generally between the first and second lint filters 18, 26. In the collection position 104 of the foreign particulate removal assembly 100, the second lint filter 26 extends downward from the binding member 102 into the housing 108. As illustrated in FIGS. 7A and 7B, the first lint filter 18 is positioned wholly above the second lint filter 26. As illustrated in FIG. 7A, in the collection position 104, the first lint filter 18 rests atop the housing 108, while the second lint filter 26 extends downward into the housing 108. As such, process air 72 may pass through the first lint filter 18 in a generally vertical direction and may subsequently pass through the second lint filter 26 in a generally horizontal direction.

Referring still to FIGS. 7A and 7B, the foreign particulate removal assembly 100 can include the first lint filter 18 coupled to a top surface 110 of the second lint filter 26. In this configuration, the first lint filter screen 22 is generally perpendicular to the second lint filter screen 30. Stated differently, the first lint filter frame 20 of the first lint filter 18 is generally perpendicular to the second lint filter frame 28 of the second lint filter 26. In this embodiment, it is contemplated that the top surface 110 of the second lint filter 26 can be the binding member 102 that operably couples to the first lint filter 18, such that the first lint filter 18 is perpendicular to the second lint filter 26. In other configurations, the first lint filter 18 defines the top surface 110 of the second lint filter 26 and the first lint filter screen 22 is generally perpendicular to the second lint filter screen 30.

Referring now to FIG. 2, a portion of the laundry appliance 10 can be transparent. The transparent portion 80 of the laundry appliance 10 may be positioned proximate to the at least one lint filter 17 in the collection position 104 of the foreign particulate removal assembly 100, such that the at least one lint filter 17 is visible through the transparent portion 80 of the laundry appliance 10. Various portions of the laundry appliance 10 may be transparent. For example, portions of the housing 108, door 62, cabinet 12 and/or a combination thereof may be transparent, in various implementations. In an exemplary embodiment, at least one of the first lint filter 18 and the second lint filter 26 may be visible through the transparent portion 80 of the housing 108 in the collection position 104 of the foreign particulate removal assembly 100.

In various embodiments, the laundry appliance 10 includes a transparent panel 82, such that the transparent panel 82 is the transparent portion 80 of the laundry appliance 10. The transparent panel 82 can be coupled to the cabinet 12 proximate to the foreign particulate removal assembly 100 in the collection position 104 of the foreign particulate removal assembly 100, such that the at least one filter 17 is visible through the transparent panel 82 in the collection position 104 of the foreign particulate removal assembly 100. In some implementations, wherein the foreign particulate removal assembly 100 is coupled to the door 62 (e.g., within the housing 108 coupled to the door 62) in the collection position 104, the transparent panel 82 is coupled to the door 62 such that the transparent panel 82 and the foreign particulate removal assembly 100 move with the door 62 as the door 62 moves between the open and closed positions. In various embodiments, the transparent panel 82 is coupled to the front side 50 of the cabinet 12 below the opening 14.

The transparent portion 80 of the laundry appliance 10 may assist a user in viewing the foreign particulates 76 accumulating on the at least one lint filter 17 during use of the laundry appliance 10. The transparent portion 80 provides a window through which to view the amount of captured foreign particulates 76 entrained within the at least one lint filter 17. This can be useful at the end of a particular laundry cycle to remind the user that the at least one lint filter 17 needs to be cleaned of the captured foreign particulates 76. The transparent portion 80 can also be useful to visually confirm the status of the at least one lint filter 17 during the course of a laundry cycle. Under certain conditions, the at least one lint filter 17 may become saturated with foreign particulates 76. In such conditions, the movement of the process air 72 can be significantly diminished. The transparent portion 80 allows the user to recognize when the at least one lint filter 17 needs to be cleaned before the completion of the laundry cycle.

Figure 10:
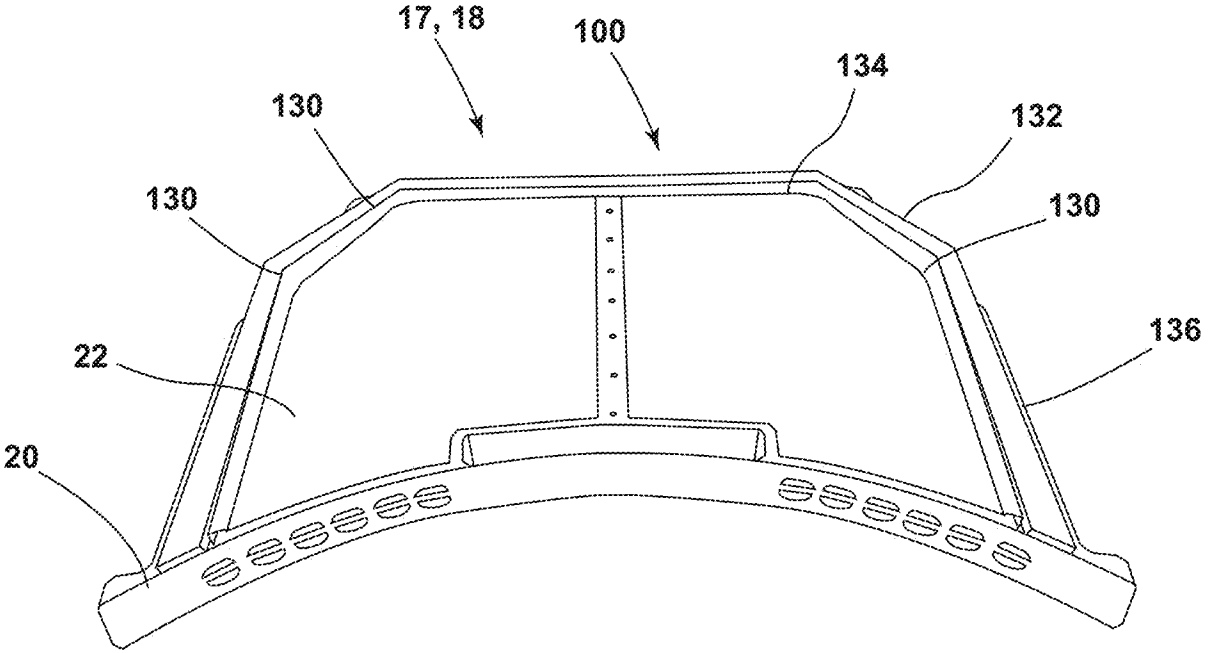
FIG. 10 is a side perspective view of a lint filter with a plurality of curved edges and a sealing interface.

Referring now to FIG. 10, the at least one lint filter 17 is illustrated as defining a plurality of curved edges 130 along the frame 21 and a sealing interface 132 along a periphery of the frame 21. The plurality of curved edges 130 can be defined at various locations along the frame 21. For example, the plurality of curved edges 130 can be formed along an interior surface 134 of the frame 21. The plurality of curved edges 130 may be adjacent to the lint filter screen 23. The plurality of curved edges 130 are configured to assist in removing the foreign particulates 76 collected on the at least one lint filter 17 by minimizing angular edges and crevices where the foreign particulates 76 can otherwise accumulate. The sealing interface 132 is configured to minimize the likelihood of the foreign particulates 76 bypassing the at least one lint filter 17 by translating around an outside edge 136 of the frame 21.

Figure 11B:
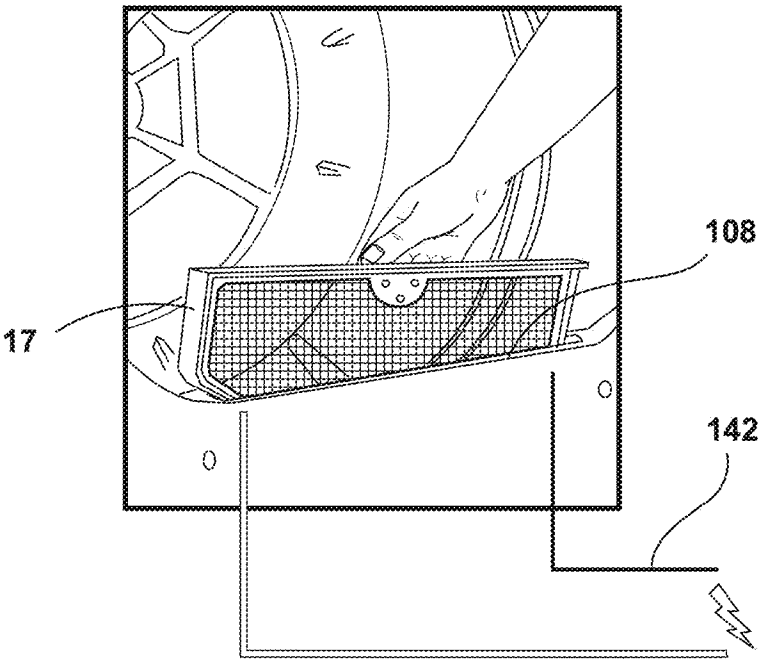
FIG. 11B is a front perspective view of a portion of a laundry appliance illustrating the lint filter of FIG. 11A being placed in a use position.
Figure 11A:
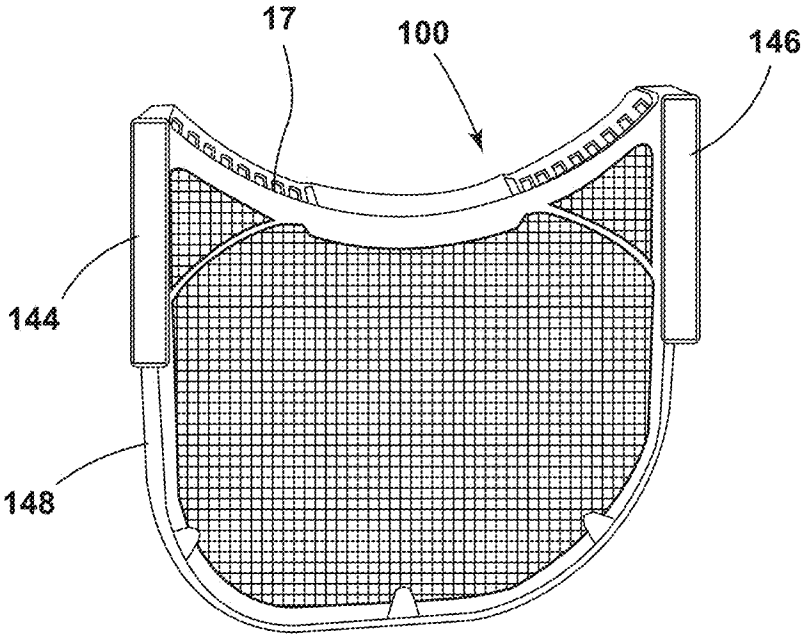
FIG. 11A is a front perspective view of a lint filter with a first metallic contact and a second metallic contact for a laundry appliance.
Figure 12:
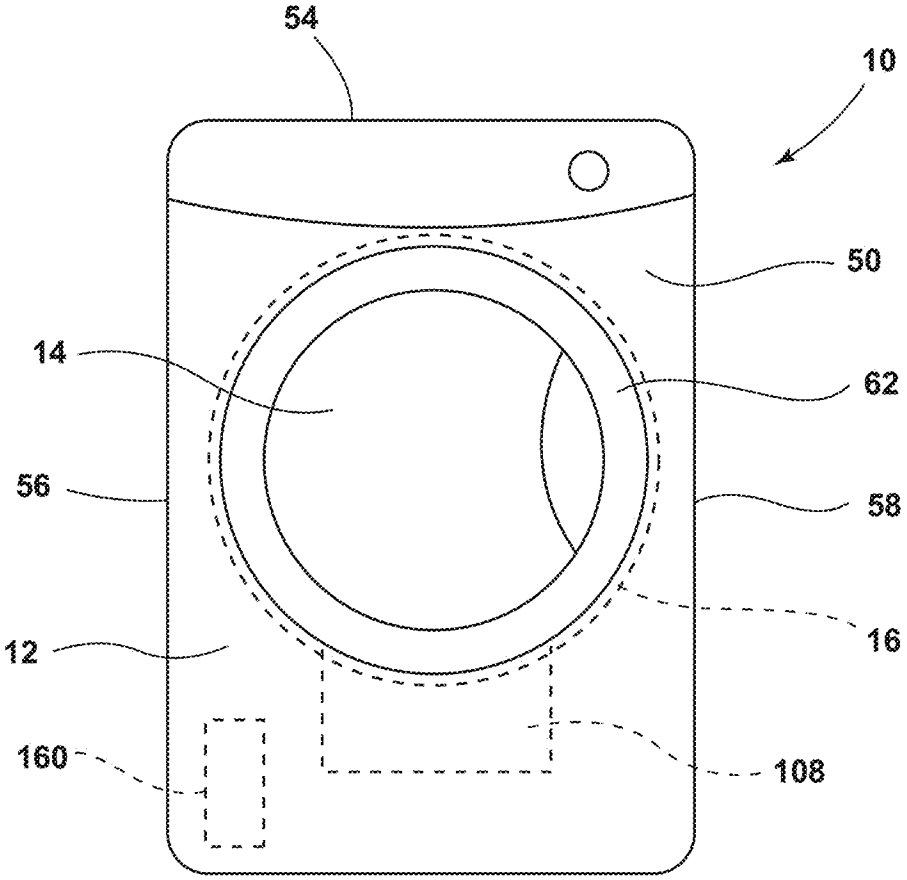
FIG. 12 is a front elevational view of a laundry appliance with an ionizer and a statically charged lint filter.

Referring now to FIGS. 11A-12, the at least one lint filter 17 can be statically charged. In some embodiments, the laundry appliance 10 includes electrical circuitry 142 that directs an electric current through the at least one lint filter 17 to statically charge the at least one lint filter 17. The static charge applied to the at least one lint filter 17 is configured to attract the foreign particulates 76 in the laundry appliance 10 and trap the foreign particulates 76 on the at least one lint filter 17. The static charge can be generated through the direct application of the electrical current or through an inductive or electromagnetic relationship.

As illustrated in FIG. 11A, the at least one lint filter 17 includes a first metallic contact 144 and a second metallic contact 146 coupled to an outer periphery 148 of the at least one lint filter 17. Additionally or alternatively, the first metallic contact 144 and the second metallic contact 146 can be coupled in various positions on the at least one lint filter 17. For example, in various implementations, the first and second metallic contacts 144, 146 can be coupled to the frame 21 of the at least one lint filter 17. The first metallic contact 144 and second metallic contact 146 are configured to electrostatically charge the statically charged lint filter 17 by forming a contact with the electrical circuitry 142 in the laundry appliance 10. The first and second metallic contacts 144, 146 direct the electric current from the electrical circuitry 142 along the at least one lint filter 17 to form the static charge. It is also contemplated that the housing 108 can be configured to apply a static charge to the at least one lint filter 17 disposed within the housing 108. In some examples, wherein the foreign particulate removal assembly 100 includes the first and second lint filters 18, 26, the first and/or second lint filters 18, 26 can be statically charged.

Referring to FIG. 12, the laundry appliance 10 can include an ionizer 160. The ionizer 160 can be configured to emit a plurality of ions onto the at least one lint filter 17. In some embodiments, wherein the at least one lint filter 17 is charged, the plurality of ions emitted by the ionizer 160 onto the at least one lint filter 17 enhance and/or form the static charge of the at least one lint filter 17. The ionizer 160 may be configured to emit electrons in various implementations. The ionizer 160 is configured to neutralize viruses, bacteria, and smells within the laundry cavity 64 via the plurality of ions. The ionizer 160 can be disposed in various locations within the laundry appliance 10.

Figure 13:
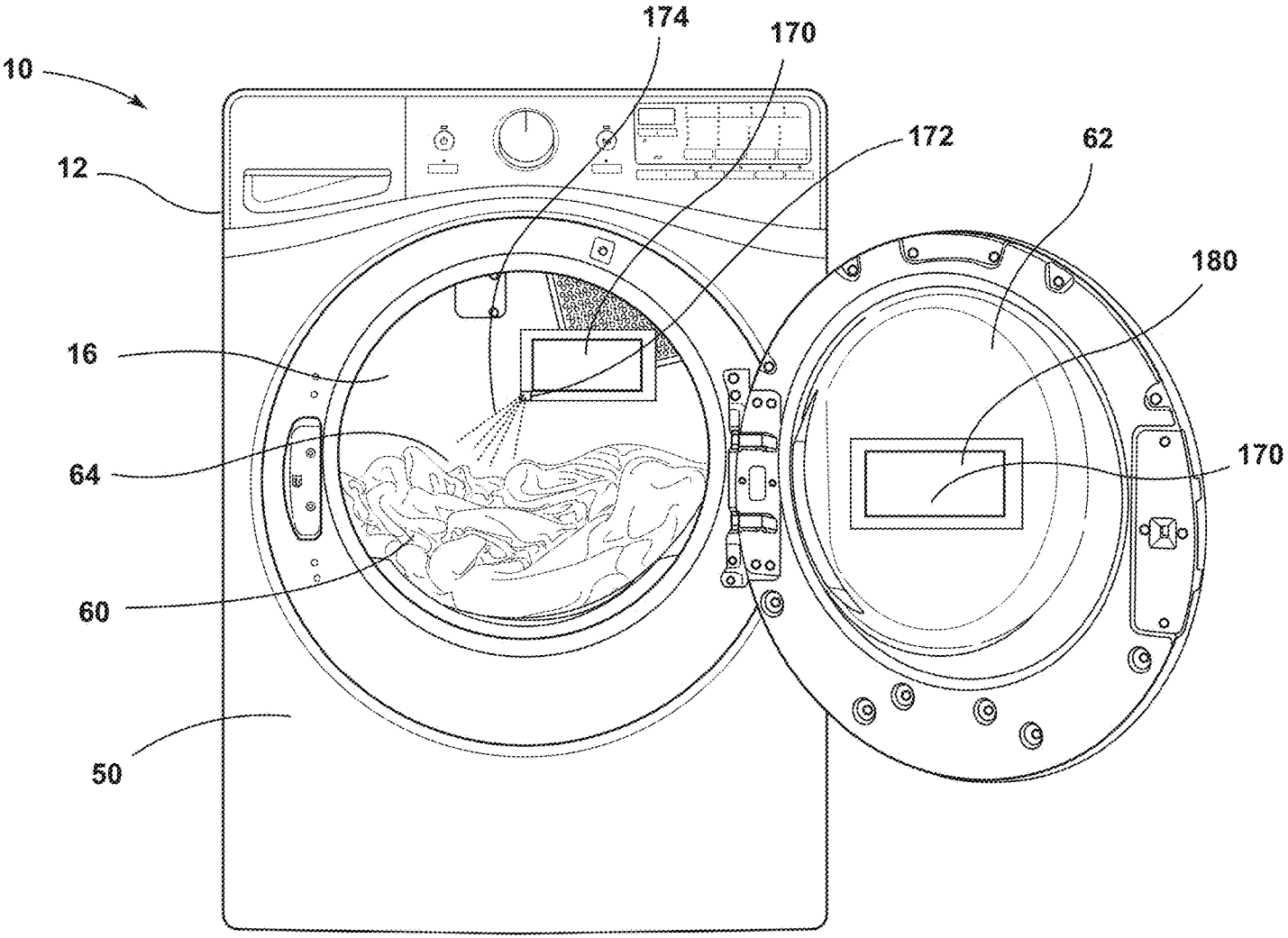
FIG. 13 is a front perspective view of a laundry appliance with a fluid emitting feature having a fluid emitting cartridge.

Referring now to FIG. 13, the laundry appliance 10 includes a fluid emitting feature 170. In some implementations, the fluid emitting feature 170 includes a nozzle 172 disposed within the drum 16 of the laundry appliance 10. By way of example, not limitation, the nozzle 172 can be a flat fan nozzle, a hollow cone nozzle, a full cone nozzle, a misting nozzle, a solid stream nozzle, or an air-atomizing nozzle. The fluid emitting feature 170 is configured to dispense a fluid 174 into the drum 16 of the laundry appliance 10. By way of example, not limitation, the fluid 174 dispensed can be a water vapor, a mixture of water and vinegar, an ionizing solution, and/or a mixture of each. The fluid 174, upon dissipation, is configured to contact the foreign particulates 76 and the clothing items 60 within the drum 16. The contact between the fluid 174 and the foreign particulates 76 can create a force sufficient to direct the foreign particulates 76 to the airflow path 36, and subsequently to the at least one lint filter 17. For example, the fluid 174 may contact and couple to the foreign particulates 76, such that the foreign particulates 76 increase in weight and drop into the airflow path 36 where the foreign particulates 76 are then collected on the at least one lint filter 17. In another example, the fluid 174 can be an anti-static solution that, upon dissipation, contacts and removes a static charge from the clothing items 60 and the foreign particulates 76 within the drum 16. In this configuration, a reduction of static charge on the clothing items 60 and foreign particulates 76 assists in directing the foreign particulates 76 away from the clothing items 60 and towards the airflow path 36 where the foreign particulates 76 can be collected on the at least one lint filter 17. It is generally contemplated that the fluid emitting feature 170 can at least dispense the fluid 174 prior to the drying cycle of the laundry appliance 10, during a stage in the drying cycle of the laundry appliance 10, or after the drying cycle of the laundry appliance 10. Additionally, it is contemplated that the laundry appliance 10 can include multiple fluid emitting features 170. For example, the laundry appliance 10 can include a plurality of nozzles 172 disposed within the drum 16 of the laundry appliance 10. It is further contemplated that each of the plurality of nozzles 172 can provide a dedicated function to be implemented based upon the type of cycle being performed and the set of selections that have been made by the user.

With further reference to FIG. 13, in other implementations, the fluid emitting feature 170 includes a fluid emitting cartridge 180 removably coupled to the door 62 of the laundry appliance 10. The fluid emitting cartridge 180 can be removably coupled to the door 62 of the laundry appliance 10 via a fastening element or a fluid emitting cartridge housing. In operation, the fluid emitting cartridge 180 is operably coupled to the door 62 of the laundry appliance 10. While in use, the fluid emitting cartridge 180 is configured to dispense the fluid 174 within the drum 16 of the laundry appliance 10. After the dispersion of the fluid 174 from the fluid emitting cartridge 180, the fluid emitting cartridge 180 is configured to be removable by a user and refilled once the fluid 174 stored within the fluid emitting cartridge 180 is dispensed. A single cartridge 180 may include a variety of fluids that can be used in combination with the various fluid nozzles 172. Additionally or alternatively, a dedicated fluid emitting cartridge 180 can be used for each type of fluid to be used in the various laundry cycles of the laundry appliance 10.

The invention disclosed herein is further summarized in the following paragraphs and is further characterized by combinations of any and all of the various aspects described therein.

According to one aspect of the present disclosure, a laundry appliance includes a cabinet that defines an opening, a drum operably coupled to the cabinet and accessible via the opening, a housing coupled to the cabinet, a foreign particulate removal assembly, and a blower that delivers process air along an airflow path. The foreign particulate removal assembly includes a first lint filter that defines a plurality of first lint filter openings, a second lint filter that defines a plurality of second lint filter openings that are smaller than the plurality of first lint filter openings, such that the second lint filter is configured to collect foreign particulates that pass through at least one of the plurality of first lint filter openings, and a binding member that couples the first lint filter to the second lint filter. The foreign particulate removal assembly is operable between a collection position and a maintenance position. In the collection position, at least the second lint filter is positioned within the housing. In the maintenance position, the second lint filter is positioned outside of the housing. The binding member couples the first and second lint filters, such that the first and second lint filters move in unison as the foreign particulate removal assembly moves between the collection and maintenance positions. The blower includes the first and second lint filters in the collection position of the foreign particulate removal assembly. The first lint filter is positioned upstream of the second lint filter within the airflow path.

According to another aspect, at least a portion of the housing is transparent, such that at least one of the first lint filter and the second lint filter is visible through the transparent portion of the housing in the collection position of the foreign particulate removal assembly.

According to another aspect, a door is pivotably coupled to the cabinet and operable to pivot between a closed position and an open position. In the closed position, the door covers the opening defined by the cabinet. In the open position, access to the drum is provided via the opening. The housing is coupled to the door, such that the housing moves with the door as the door moves between the open and closed positions.

According to another aspect, the housing is positioned below the opening defined by the cabinet, and the first and second lint filters extend downward from the binding member into the housing in the collection position of the foreign particulate removal assembly.

According to another aspect, the housing is positioned below the opening defined by the cabinet, the second lint filter extends downward from the binding member into the housing in the collection position of the foreign particulate removal assembly, and the first lint filter is positioned wholly above the second lint filter in the collection position of the foreign particulate removal assembly.

According to another aspect, electrical circuitry is coupled to the first lint filter in the collection position of the foreign particulate removal assembly and configured to convey electric current through the first lint filter to statically charge the first lint filter.

According to another aspect, the first lint filter includes a frame, a first lint filter screen coupled to the frame, a first metallic contact coupled to the frame, and a second metallic contact coupled to the frame. Electrical circuitry is coupled to the first and second metallic contacts in the collection position of the foreign particulate removal assembly, such that electric current is conveyed across the first lint filter from the first metallic contact to the second metallic contact.

According to another aspect of the present disclosure, a laundry appliance includes a cabinet that defines an opening, a drum operably coupled to the cabinet and accessible via the opening, a blower within the cabinet that delivers process air along an airflow path, a foreign particulate removal assembly having at least one lint filter and being operable between a collection position and a maintenance position, and a transparent panel. In the collection position of the foreign particulate removal assembly, the at least one lint filter is within the airflow path. In the maintenance position of the foreign particulate removal assembly, the at least one lint filter is outside the airflow path. The transparent panel is coupled to the cabinet proximate to the foreign particulate removal assembly in the collection position of the foreign particulate removal assembly, such that the at least one lint filter is visible through the transparent panel in the collection position of the foreign particulate removal assembly.

According to another aspect, a door is pivotably coupled to the cabinet and operable to pivot between a closed position and an open position. In the closed position, the door covers the opening defined by the cabinet. In the open position, access to the drum is provided via the opening. The transparent panel is coupled to the door and the foreign particulate removal assembly is coupled to the door in the collection position, such that the transparent panel and the foreign particulate removal assembly move with the door as the door moves between the open and closed positions.

According to another aspect, electrical circuitry coupled to the at least one lint filter in the collection position of the foreign particulate removal assembly and configured to convey electric current through the at least one lint filter to statically charge the at least one lint filter.

According to another aspect, the at least one lint filter includes a frame, a lint filter screen coupled to the frame, a first metallic contact coupled to the frame, and a second metallic contact coupled to the frame. Electrical circuitry is coupled to the first and second metallic contacts in the collection position of the foreign particulate removal assembly, such that electric current is conveyed across the at least one lint filter from the first metallic contact to the second metallic contact.

According to another aspect, an ionizer is disposed within the cabinet and configured to emit a plurality of ions into the drum.

According to another aspect, a fluid emitting feature selectively dispenses a fluid into the drum.

According to another aspect, the fluid emitting feature includes a fluid cartridge that is operably coupled to a door coupled to the cabinet.

According to another aspect, the at least one lint filter of the foreign particulate removal assembly includes a first lint filter and a second lint filter. The foreign particulate removal assembly further includes a binding member that couples the first lint filter with the second lint filter. The first and second lint filters move in unison as the foreign particulate removal assembly moves between the collection and maintenance positions.

According to another aspect, the first lint filter is positioned wholly above the second lint filter in the collection position of the foreign particulate removal assembly.

According to yet another aspect of the present disclosure, a laundry appliance includes a cabinet that defines an opening, a drum operably coupled to the cabinet and accessible via the opening, a door pivotably coupled to the cabinet and operable to pivot between a closed position and an open position, a housing coupled to the door, such that the housing moves with the door as the door pivots between the open and closed positions, a foreign particulate removal assembly having at least one lint filter and being operable between a collection position and a maintenance position, and a blower that delivers process air along an airflow path that includes the at least one lint filter in the collection position of the foreign particulate removal assembly and in the closed position of the door. In the closed position of the door, the door covers the opening defined by the cabinet. In the open position of the door, access to the drum is provided via the opening. In the collection position of the foreign particulate removal assembly, the at least one lint filter is positioned within the housing. In the maintenance position of the foreign particulate removal assembly, the at least one lint filter is positioned outside of the housing.

According to another aspect, a portion of at least one of the housing and the door is transparent, such that the at least one lint filter is visible through the transparent portion in the collection position of the foreign particulate removal assembly.

According to another aspect, a fluid emitting feature selectively dispenses a fluid into the drum.

According to another aspect, the fluid emitting feature includes a fluid cartridge that is operably coupled to the door.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance, comprising:

a cabinet that defines an opening;

a drum operably coupled to the cabinet and accessible via the opening;

a housing coupled to the cabinet;

a foreign particulate removal assembly, comprising:

first lint filter that defines a plurality of first lint filter openings;

a second lint filter that defines a plurality of second lint filter openings that are smaller than the plurality of first lint filter openings, such that the second lint filter is configured to collect foreign particulates that pass through at least one of the plurality of first lint filter openings; and a binding member that couples the first lint filter to the second lint filter, the foreign particulate removal assembly being operable between a collection position, wherein at least the second lint filter is positioned within the housing, and a maintenance position, wherein the second lint filter is positioned outside of the housing, wherein the binding member couples the first and second lint filters, such that the first and second lint filters move in unison as the foreign particulate removal assembly moves between the collection and maintenance positions; a blower that delivers process air along an airflow path that includes the first and second lint filters in the collection position of the foreign particulate removal assembly, wherein the first lint filter is positioned upstream of the second lint filter within the airflow path; and electrical circuitry coupled to the first lint filter in the collection position of the foreign particulate removal assembly and configured to convey electric current through the first lint filter to statically charge the first lint filter, the first lint filter comprising:

a frame;

a first lint filter screen coupled to the frame;

a first metallic contact coupled to the frame; and a second metallic contact coupled to the frame, wherein the electrical circuitry is coupled to the first and second metallic contacts in the collection position of the foreign particulate removal assembly, such that electric current is conveyed across the first lint filter from the first metallic contact to the second metallic contact.

2. The laundry appliance of claim 1, wherein at least a portion of the housing is transparent, such that at least one of the first lint filter and the second lint filter is visible through the transparent portion of the housing in the collection position of the foreign particulate removal assembly.

3. The laundry appliance of claim 1, further comprising:

a door pivotably coupled to the cabinet and operable to pivot between a closed position, wherein the door covers the opening defined by the cabinet, and an open position, wherein access to the drum is provided via the opening, and wherein the housing is coupled to the door, such that the housing moves with the door as the door moves between the open and closed positions.

4. The laundry appliance of claim 1, wherein the housing is positioned below the opening defined by the cabinet, and the first and second lint filters extend downward from the binding member into the housing in the collection position of the foreign particulate removal assembly.

5. The laundry appliance of claim 1, wherein the housing is positioned below the opening defined by the cabinet, the second lint filter extends downward from the binding member into the housing in the collection position of the foreign particulate removal assembly, and the first lint filter is positioned wholly above the second lint filter in the collection position of the foreign particulate removal assembly.

6. The laundry appliance of claim 1, further comprising:

an ionizer disposed within the cabinet and configured to emit a plurality of ions into the drum.

7. The laundry appliance of claim 1, further comprising:

a fluid emitting feature that selectively dispenses a fluid into the drum.

8. The laundry appliance of claim 7, wherein the fluid emitting feature includes a fluid cartridge that is operably coupled to a door coupled to the cabinet.

9. A laundry appliance, comprising:

a cabinet that defines an opening;

a drum operably coupled to the cabinet and accessible via the opening;

a blower within the cabinet that delivers process air along an airflow path;

a foreign particulate removal assembly having at least one lint filter and being operable between a collection position, wherein the at least one lint filter is within the airflow path, and a maintenance position, wherein the at least one lint filter is outside the airflow path; and a transparent panel coupled to the cabinet proximate to the foreign particulate removal assembly in the collection position of the foreign particulate removal assembly, such that the at least one lint filter is visible through the transparent panel in the collection position of the foreign particulate removal assembly; and a door pivotably coupled to the cabinet and operable to pivot between a closed position, wherein the door covers the opening defined by the cabinet, and an open position, wherein access to the drum is provided via the opening, and wherein the transparent panel is coupled to the door and the foreign particulate removal assembly is coupled to the door in the collection position, such that the transparent panel and the foreign particulate removal assembly move with the door as the door moves between the open and closed positions.

10. The laundry appliance of claim 9, further comprising:

electrical circuitry coupled to the at least one lint filter in the collection position of the foreign particulate removal assembly and configured to convey electric current through the at least one lint filter to statically charge the at least one lint filter.

11. The laundry appliance of claim 10, wherein the at least one lint filter comprises:

a frame;

a lint filter screen coupled to the frame;

a first metallic contact coupled to the frame; and a second metallic contact coupled to the frame, wherein the electrical circuitry is coupled to the first and second metallic contacts in the collection position of the foreign particulate removal assembly, such that electric current is conveyed across the at least one lint filter from the first metallic contact to the second metallic contact.

12. The laundry appliance of claim 10, further comprising:

an ionizer disposed within the cabinet and configured to emit a plurality of ions into the drum.

13. The laundry appliance of claim 9, further comprising:

a fluid emitting feature that selectively dispenses a fluid into the drum.

14. The laundry appliance of claim 13, wherein the fluid emitting feature includes a fluid cartridge that is operably coupled to a door coupled to the cabinet.

15. The laundry appliance of claim 9, wherein the at least one lint filter of the foreign particulate removal assembly comprises:

a first lint filter; and a second lint filter, and further wherein the foreign particulate removal assembly further comprises:

a binding member that couples the first lint filter with the second lint filter, wherein the first and second lint filters move in unison as the foreign particulate removal assembly moves between the collection and maintenance positions.

16. The laundry appliance of claim 15, wherein the first lint filter is positioned wholly above the second lint filter in the collection position of the foreign particulate removal assembly.

17. A laundry appliance, comprising:

a cabinet that defines an opening;

a drum operably coupled to the cabinet and accessible via the opening;

a door pivotably coupled to the cabinet and operable to pivot between a closed position, wherein the door covers the opening defined by the cabinet, and an open position, wherein access to the drum is provided via the opening;

a housing coupled to the door, such that the housing moves with the door as the door pivots between the open and closed positions;

a foreign particulate removal assembly having at least one lint filter and being operable between a collection position, wherein the at least one lint filter is positioned within the housing, and a maintenance position, wherein the at least one lint filter is positioned outside of the housing; and a blower that delivers process air along an airflow path that includes the at least one lint filter in the collection position of the foreign particulate removal assembly and in the closed position of the door.

18. The laundry appliance of claim 17, wherein a portion of at least one of the housing and the door is transparent, such that the at least one lint filter is visible through the transparent portion in the collection position of the foreign particulate removal assembly.

19. The laundry appliance of claim 17, further comprising:

a fluid emitting feature that selectively dispenses a fluid into the drum.

20. The laundry appliance of claim 19, wherein the fluid emitting feature includes a fluid cartridge that is operably coupled to the door.

* * * * *